US006405432B1

(12) United States Patent
Sedor et al.

(10) Patent No.: US 6,405,432 B1
(45) Date of Patent: Jun. 18, 2002

(54) POTENTIOMETER MOUNTING CLIP FOR A JOYSTICK CONTROLLER

(75) Inventors: Thomas M. Sedor, Chicago; Theodore Valavanis, Lake Forest, both of IL (US)

(73) Assignee: Midway Games Inc., Chicago, IL (US)

( * ) Notice: Subject to any disclaimer, the term of this patent is extended or adjusted under 35 U.S.C. 154(b) by 0 days.

(21) Appl. No.: 09/439,699

(22) Filed: Nov. 15, 1999

Related U.S. Application Data

(62) Division of application No. 09/187,629, filed on Nov. 6, 1998, now Pat. No. 6,040,758.

(51) Int. Cl.[7] ..... H01R 43/00

(52) U.S. Cl. ..... 29/854; 29/622; 338/197; 338/128

(58) Field of Search ..... 338/68, 98, 50, 338/128, 197, 316, 315; 24/458, 462, 563, 312, 67.9, 67.3; 345/161; 29/610.1, 622, 854, 876, 774, 881

(56) References Cited

U.S. PATENT DOCUMENTS

| | | | | |
|---|---|---|---|---|
| 2,566,886 A | | 9/1951 | Hartman | 24/458 |
| 2,744,986 A | * | 5/1956 | Caldwell | 201/60 |
| 2,903,663 A | * | 9/1959 | Collina | 336/134 |
| 2,942,220 A | | 6/1960 | Elliott et al. | 338/197 |

(List continued on next page.)

FOREIGN PATENT DOCUMENTS

| | | |
|---|---|---|
| EP | 0 349 714 A2 | 1/1990 |
| GB | 2 091 423 | 7/1982 |

OTHER PUBLICATIONS

Advertisement: "JSP3000 SERIES Joystick", Maurey Instrument Corp., date unknown.

Catalog: Happ Controls 1998 Amusement Products Catalog.

Advertisement: "Induction Type Joystick Control", Maurey Instrument Corp., date unknown.

Advertisement: "Precision Joystick Controls With Potentiometers", Maurey, date unknown.

*Primary Examiner*—Peter Vo
*Assistant Examiner*—Sean Smith
(74) *Attorney, Agent, or Firm*—Jenkens & Gilchrist

(57) ABSTRACT

A mounting clip for a rotary potentiometer. In a preferred embodiment, the mounting clip comprises front and back generally vertical opposing side segments elastically deformable relative to each other between a naturally biased position and an outward flexed position. The back side segment defines a pair of legs sized to accommodate a shaft of the potentiometer. The mounting clip is useful for mounting the rotary potentiometer relative to a support wall of a joystick assembly in a position wherein a body portion of the potentiometer is adjacent to the support wall and the shaft of the potentiometer projects through an opening in the support wall. When the potentiometer is so positioned, the mounting clip may be slid downward over the potentiometer and support wall such that the front side segment overlies an outer flat surface of the potentiometer and the legs straddle the shaft of the potentiometer on the other side of the support wall. Because the potentiometer shaft projects non-fixedly through the legs and the opening in the support wall, it is permitted to deflect in response to intermittent side-loading forces.

15 Claims, 7 Drawing Sheets

U.S. PATENT DOCUMENTS

| | | | | | |
|---|---|---|---|---|---|
| 3,047,682 | A | * | 7/1962 | Hults | 200/16 |
| 3,434,342 | A | * | 3/1969 | Kazmarek | 73/133 |
| 3,765,065 | A | | 10/1973 | Hay | 24/563 |
| 3,939,451 | A | | 2/1976 | Kasahima | 338/128 |
| 4,250,378 | A | | 2/1981 | Mutton | |
| 4,305,007 | A | | 12/1981 | Hughes | |
| 4,306,208 | A | | 12/1981 | Coors | |
| 4,436,971 | A | | 3/1984 | Kim | 200/295 |
| 4,489,304 | A | | 12/1984 | Hayes | 338/128 |
| 4,601,247 | A | | 7/1986 | Welch et al. | 24/458 |
| 4,685,678 | A | | 8/1987 | Frederiksen | |
| 4,738,007 | A | | 4/1988 | Demarest, Jr. | 24/67.9 |
| 4,771,807 | A | * | 9/1988 | Karani | 137/553 |
| 4,856,785 | A | | 8/1989 | Lantz et al. | |
| 4,857,881 | A | | 8/1989 | Hayes | 338/128 |
| 4,883,397 | A | | 11/1989 | Dubost | 24/67.9 |
| 5,201,799 | A | | 4/1993 | Johnson | 24/563 |
| 5,317,301 | A | | 5/1994 | DeVolpi | 338/128 |
| 5,406,031 | A | * | 4/1995 | Mathieu et al. | 29/854 |
| 5,452,512 | A | * | 9/1995 | Foley | 29/874 |
| 5,886,873 | A | | 3/1999 | Ahn | 24/563 |
| 5,915,758 | A | * | 6/1999 | Alfiero | 29/874 |
| 6,134,771 | A | * | 10/2000 | Nakamura et al. | 29/874 |

* cited by examiner

POTENTIOMETER MOUNTING CLIP FOR A JOYSTICK CONTROLLER

This application is a divisional of application Ser. No. 09/187,629, filed on Nov. 6, 1998 now U.S. Pat. No. 6,040,758.

FIELD OF THE INVENTION

The present invention relates generally to joystick controllers and, more particularly, to a mounting clip useful for mounting potentiometers in a joystick controller.

BACKGROUND OF THE INVENTION

Joysticks are well known devices for controlling movement of devices or symbols. Joysticks are commonly used in video games, for example, to effect real or simulated movement of game characters or symbols on a video display. Generally, joysticks consist of a lever mounted for pivotal movement between various radial positions, wherein electrical output signals corresponding to the joystick positions are communicated to a controller (e.g., game controller). The controller, in turn, processes the electrical signals and, according to a game program, manipulates the character(s) or symbol(s) under control corresponding to the various positions of the joystick.

Generally, the types and degree of control which may be achieved over the character(s) or symbol(s) in the video game is determined both by the sophistication of the joystick used in the game and by the game program. Virtually all joysticks are capable of providing some directional control, for example, but the degree or precision of such directional control can vary greatly depending on the mechanical and/or electrical characteristics of the joystick. For example, a "4-way" joystick is movable between only four angular positions, 90° apart and an "8-way" joystick is movable between 8 angular positions, 45° apart. Other more sophisticated types of joysticks provide velocity, as well as directional control, by providing electrical output signals to the controller corresponding to the degree of deflection of the joystick from its initial parked or "detent" position. As with directional controls, the degree or precision of velocity controls can also vary greatly depending on the mechanical and/or electrical characteristics of the joystick.

It is known that high precision directional or velocity control may be achieved by using potentiometers in joystick controllers. One form of potentiometer which may be used for this purpose is an analog rotary potentiometer, which includes a shaft mounted for rotation about an axis such that rotation of the shaft communicates analog electrical signals to the controller. Where two such potentiometers are employed, they are normally coupled to the joystick structure along two orthogonal axes (e.g., an "x" and "Y" axis) such that each individual potentiometer shaft rotates to a position corresponding to the displacement component of the joystick along one of the two axes. The combination of the two potentiometers can thereby communicate electrical signals to the controller corresponding to virtually any position of the joystick in a two-dimensional plane (e.g., the "x-y" plane). The electrical output signals, in turn, may be processed by the game controller to provide several hundreds of discrete variables for directional, velocity or other manner of control. Of course, the degree of control depends on the number and configuration of potentiometers employed in the joystick and the characteristics of the game program responsive to the potentiometer signals.

While analog joysticks generally offer tremendous advantages in control relative to other types of joysticks, both the degree of control which may be achieved by the joysticks and their failure rate can be compromised by the manner in which the potentiometers are mounted to the joystick structure. In particular, a common problem heretofore encountered in analog joysticks is side-loading of the potentiometer shafts. Side-loading may occur as a result of aggressive handling of the joystick controller during, use and/or from "pre-loading" or fixedly mounting the potentiometer shaft in misalignment with the desired axis of rotation. In either case, the side-loading forces can result in eccentric rotation of the potentiometer shaft which can cause premature failure of the joystick and decrease its accuracy. This problem is generally exacerbated where the potentiometers are fixedly secured to the joystick structure as presently known (e.g., with a mounting nut) in a manner which does not permit the potentiometer some freedom of motion or "play" to dissipate the side-loading forces.

Moreover, with the present method of securing potentiometers to the joystick structure with a mounting nut, there is generally only a small, cramped space in the structure wherein the mounting nut is to be secured about the shaft of the potentiometer and, accordingly, the process of manipulating the mounting nut within such small space is generally a cumbersome, rather time consuming process.

Accordingly, there is a need for a method and apparatus for mounting potentiometers in a joystick controller in a manner that overcomes or at least reduces the effects of the side-loading problems and/or mounting difficulties discussed above. The present invention is directed to addressing this need.

SUMMARY OF THE INVENTION

In accordance with one aspect of the present invention, there is provided a mounting clip for securing a rotary potentiometer relative to a support wall, wherein the potentiometer defines a body portion and a shaft and the support wall has an opening therein for accommodating the potentiometer shaft. The potentiometer and support wall may comprise portions of a joystick assembly. The mounting clip comprises front and back generally vertical opposing side segments and a top segment bridging the front and back side segments. When the potentiometer is secured to the support wall by the mounting clip, the body portion of the potentiometer and a portion of the support wall is received and retained between the front and back side segments of the mounting clip and the potentiometer shaft projects through the opening in the support wall. In a preferred embodiment, the potentiometer shaft when so mounted projects non-fixedly through the opening in the support wall so that both the potentiometer shaft and body are permitted to deflect in response to intermittent side-loading forces.

In accordance with another aspect of the present invention, there is provided a method of mounting a rotary potentiometer relative to a support wall of a joystick assembly. The potentiometer defines a generally disk-shaped body portion and a shaft, wherein the body portion comprises an outer flat surface and an inner flat surface bridged by a cylindrical surface and the potentiometer shaft projects outwardly from the inner flat surface along a longitudinal axis. The support wall has an opening therein for accommodating the potentiometer shaft. Mounting of the potentiometer is accomplished in one embodiment by first placing the potentiometer in a position wherein the inner flat surface is adjacent to the support wall and the potentiometer shaft penetrates through the opening in the support wall. Next, a mounting clip comprising front and back opposing side segments and a top segment is oriented above the potentiometer in a position wherein the front side segment is oriented generally vertically above the outer flat surface of the potentiometer and a lower portion of the back side segment is engaged with the support wall. The back side segment of the mounting clip defines a pair of legs, a bottom portion of the front side segment turns inwardly toward the back side segment to define a bottom flange, and the front and back side segments are elastically deformable relative to each other between a naturally biased position and an outward flexed position. With the legs of the mounting clip engaged with the back of the support wall, the front side segment is flexed outwardly toward its outward flexed position and the mounting clip is pushed downward in a sliding contact until the bottom flange snaps underneath the body portion of the potentiometer.

BRIEF DESCRIPTION OF THE DRAWINGS

The foregoing and other advantages of the invention will become apparent upon reading the following detailed description and upon reference to the drawings in which.

Figure 1B:
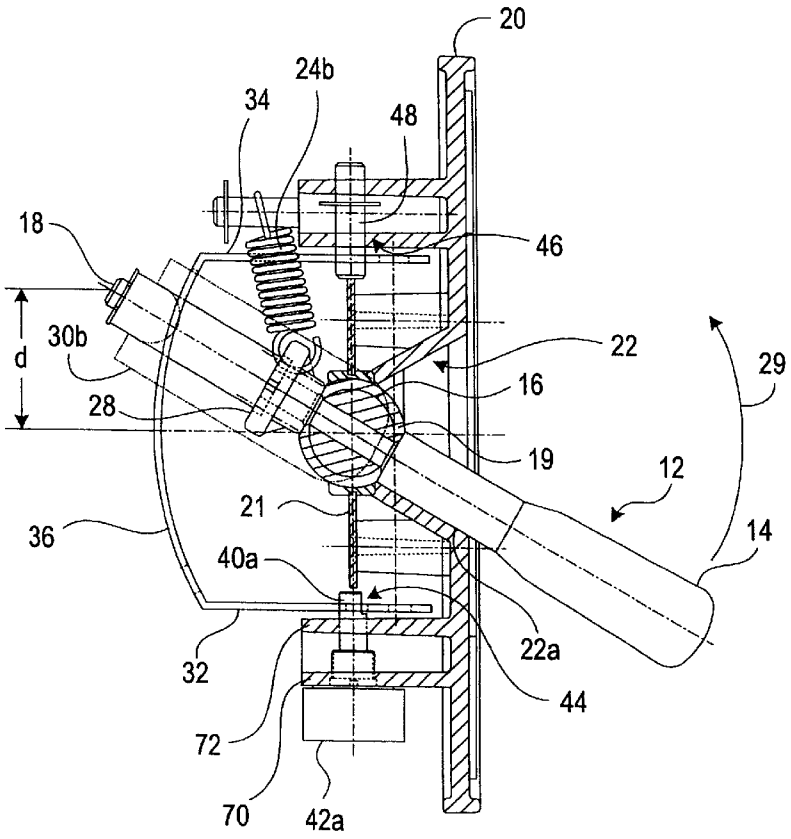
FIG. 1*b* is a side view of the joystick assembly of FIG. 1*a;*

While the invention is susceptible to various modifications and alternative forms, specific embodiments have been shown by way of example in the drawings and will be described in detail herein. However, it should be understood that the invention is not intended to be limited to the particular forms disclosed. Rather, the invention is to cover all modifications, equivalents, and alternatives falling within the spirit and scope of the invention as defined by the appended claims.

DESCRIPTION OF SPECIFIC EMBODIMENTS

Figure 1A:
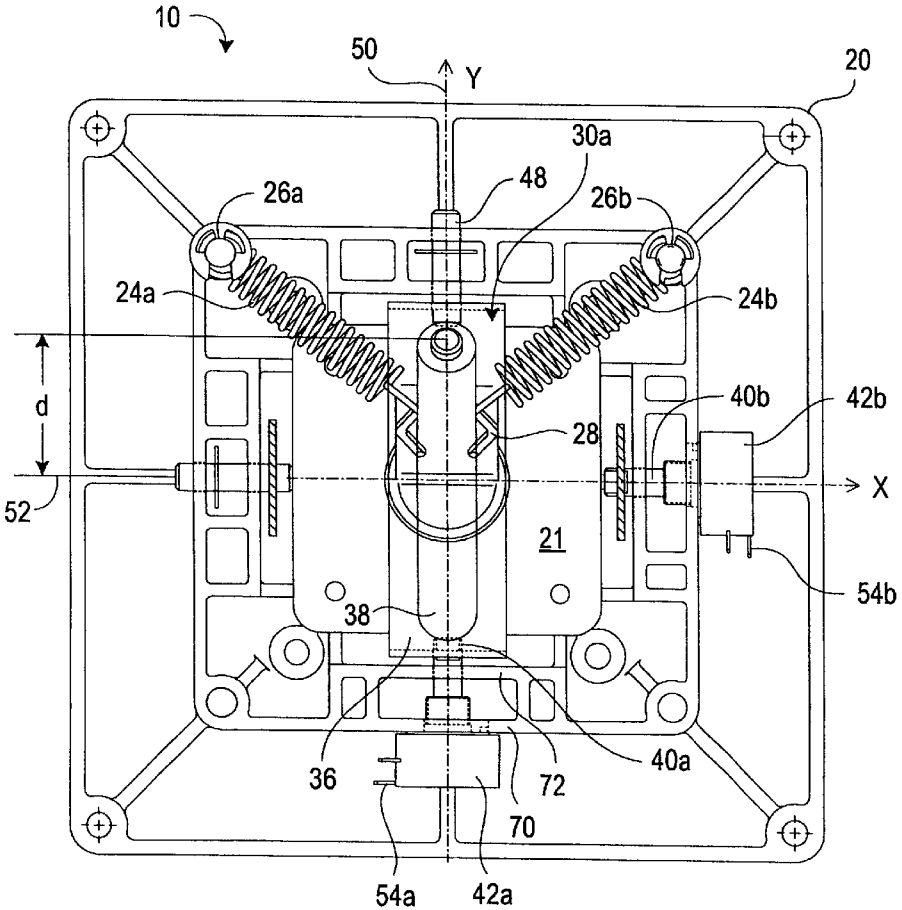
FIG. 1*a* is a bottom view of a joystick assembly having a side-detent characteristic according to on embodiment of the present invention.

Turning now to the drawings and referring initially to FIGS. 1*a* and 1*b*, there is shown a joystick assembly 10 having a side-detent characteristic according to one embodiment of the present invention. The joystick assembly 10 includes a joystick 12 having a handle 14, a pivoting center ball 16 and a bottom shaft 18 mounted to a platform 20. The platform 20 has a cut-out portion defining a channel 22 for receiving the handle 14. The boundaries of the channel 22 restricts the range of motion of the handle 14, as will be described in greater detail in reference to FIG. 2. The joystick 12 in the illustrated embodiment rests normally in a side-detent position, that is with the handle 14 biased toward an outermost edge of the channel 22 by the pulling force of two spring elements 24*a,b*. In one embodiment, the spring elements 24*a,b* each comprise 5–6 in-lb extension springs constructed from music wire or stainless steel. It will be appreciated however, that references to "springs" or "spring elements" throughout this application shall be considered to encompass various alternative types and compositions of springs or spring alternatives. Springs having lesser or greater tension may be used, for example, to effect a different mechanical feel of the joystick 12. Springs having a different construction might also be used. For example, compression springs may be used, or the spring elements might be constructed from a thermoplastic elastomer (TPE), a substance with generally "rubber-band-like" qualities.

The springs 24*a,b* are connected at one end to respective support rods 26*a,b* mounted in the platform 20 and at another end to a support bushing 28 surrounding the bottom shaft 18 of the joystick at a position adjacent the center ball 16. The center ball 16 is received within a ball race 19 mounted on a subsidiary platform 21. As best observed in FIG. 1*b*, the springs 24*a,b* are positioned generally parallel to the support platform 20 at a relative depth which is less than one-half the depth (i.e., length) of the bottom shaft. In one embodiment, for example, the bottom shaft 18 extends radially from the center ball 16 by a distance of about 2 inches, whereas the springs 24*a,b* have a maximum depth of less than one inch from the center ball. The entire joystick assembly in one embodiment has a depth of about 3½ inches, measured from a bottom of the platform 20 to the distal end of the bottom shaft 18. The joystick assembly in one embodiment has a square "footprint" defined by the sides of the support platform 20. In one embodiment, each of the sides of the platform 20 is 6.3 inches in length, thus defining a footprint area of 40 square inches. In one embodiment, the subsidiary platform 21 upon which the center ball is mounted also has a square footprint defined by sides which are 4.4 inches in length.

To operate the joystick 12, one pulls the handle 14 in a direction generally indicated by arrow 29 against the biasing force of the springs 24*a,b* to a desired position within the confines of the channel 22. The bottom shaft 18 of the joystick moves cooperatively with the handle 14 to a position generally opposite that of the handle 14. Movement of the bottom shaft 18 in turn is communicated by means of rotatable brackets 30*a,b* to respective shafts 40*a,b* of two potentiometers 42*a,b*. For convenience, only one of the two brackets 30*a,b* is shown in FIGS. 1*a* and 1*b*. Each of the brackets 30 define generally yoke-shaped or U-shaped structures having a pair of opposing legs 32, 34 connected by a bridging span 36, wherein the bridging span 36 includes an elongated slot 38 for receiving the bottom shaft 18 of the joystick. In each bracket 30, one of the legs 32, 34 includes a generally D-shaped hole 44 sized to receive a distal end of the potentiometer shaft 40 having a complementary shape and the other of each pair of legs 32,34 includes a circular hole 46 sized to receive a distal end of a mounting shaft or axle 48 having a complementary shape.

Each of the brackets 30 is positioned orthogonally (i.e., at a right angle) to the other bracket 30 and each bracket 30 is thereby responsive to one component of motion of the bottom shaft 18 in a two-dimensional plane (e.g., an "x-y" plane). The potentiometers 42*a,b*, in turn, are also coupled to the structure 20 along two orthogonal axes such that the respective potentiometer shafts 40*a,b* rotate to positions corresponding to the positions of the respective brackets 30*a,b*. The potentiometers 42*a,b* are mounted such that their body remains fixed and only their shafts 40*a,b* rotate in response to motion of the bottom shaft 18 and brackets 30. In accordance with one aspect of the present invention, the potentiometers 42*a,b* are mounted to the joystick platform with a mounting clip (not shown), which will be described in detail in relation to FIGS. 5*b* through 9*d*.

For convenience, the joystick assembly of FIG. 1*a* is shown in relation to an x-y coordinate system having an "x" axis 52 oriented horizontally and a "y" axis 50 oriented vertically relative to the support platform 20. The origin of the x-y coordinate system is at the center of the support platform 20. In the embodiment of FIGS. 1*a* and 1*b*, the respective brackets 30*a* and 30*b* are movable in response to "x" and "y" components of movement of the bottom shaft 18. In particular, bracket 30*a* is initially positioned at x=0 (in alignment with the "y" axis 50) and is movable left and right along the "x" axis in response to "x" components of movement of the bottom shaft 18. Bracket 30*b* (FIG. 1*b*) is initially positioned at y=d (parallel to the "x" axis 52 and displaced by a distance d) and is movable along the "y" axis in response to "y" components of movement of the bottom shaft 18. Movement of the respective brackets 30*a,b* causes movement of the respective potentiometer shafts 40*a,b*, thereby communicating electrical signals through leads 54*a,b* to a controller (not shown) which processes the signals to control movement of the game character, symbol or other item under control.

In the embodiment of FIGS. 1*a* and 1*b*, with the bottom shaft 18 in its naturally-biased position, the springs 24*a,b* are oriented at an angle of about 45 degrees relative to the respective brackets 30*a,b* such upon movement of either bracket 30*a,b*, each spring 24*a,b* contributes a biasing force to the bottom shaft 18. In one embodiment, the springs 24*a,b* in their basic free-length form have a length of about 1¾ inches and, as best observed in FIG. 1*a*, are pre-loaded to about 1.2 times their initial free length, or about 2¼ inches. When fully extended, the springs 24*a,b* are stretched to about 1.6 times their initial free length, or about 3 inches. It will be appreciated, however, that other designs according to the present invention may include alternate orientations and/or stretched configurations of the springs 24*a,b*. Preferably, however, the springs 24*a,b* will be oriented at an angle relative to the respective brackets 30*a,b* and will be pre-loaded when the bottom shaft is in its naturally-biased position to produce a non-guided feel (i.e., an absence of preferential motion) when moving the shaft 18 about the x- and y- axes.

According to well known principles of physics, an unloaded spring (i.e., a spring which is in its initial free-length state), tends to resist displacement from its free-length state and will begin to stretch (in the case of a tension spring) or compress (in the case of a compression spring) only upon application of a force which exceeds a certain discrete load level. The level at which a spring will begin to stretch or compress depends on the physical characteristics of the spring. Once the characteristic load level has been reached, the spring will stretch or compress in linear proportion to the amount of applied force. In the present invention, by pre-loading the springs past their characteristic load level, the initial resistance of the springs to displacement has already been overcome and the springs will stretch in linear proportion to any component of movement of the joystick handle. The effect is that the joystick feels as if it is equally resistant to movement in each direction.

In particular, consider the forces contributed by the springs in response to various movements of the bottom shaft 18. In the initial position and at any position along the "y" axis 50, each of the springs 24*a,b* are pre-loaded and the bottom shaft 18 is subject to an equal biasing force from each spring 24*a,b*. As the bottom shaft 18 is moved incrementally along the "x" axis 52, one of the springs 24*a,b* will begin to contribute a greater biasing force than the other spring 24*a,b* (the degree of force being dependent on the displacement of the bottom shaft in both the x and y axes), but the net biasing force contributed by the two springs 24*a,b* does not significantly vary in response to incremental movement of the bottom shaft. Consequently, because the net biasing force contributed by the springs 24*a,b* does not appreciably change in response to incremental movements of the joystick 12, the joystick 12 exhibits an unguided "feel" as it is moved about the x- and y- axes. Thus, there is no particular axis which may be considered to comprise a "preferential" axis of movement of the joystick 12.

Joystick apparatus 10 thereby defines a structure which provides non-preferential movement of the joystick 12 by the action of springs 24*a,b* which are mounted parallel to the support structure 20. Because the springs 24*a,b* are mounted at a relative depth which is only about one-half the depth reached by the bottom shaft 18, the entire joystick assembly 10 is relatively compact so that it may be mounted within a relatively small space. For example, the overall mounting depth of the joystick assembly in one embodiment is about 3¼ or 3½ inches. While this feature is advantageous for any game, it is particularly advantageous in retrofit applications where the available space for the joystick apparatus can be limited by the prior game cabinet design.

Figure 2:
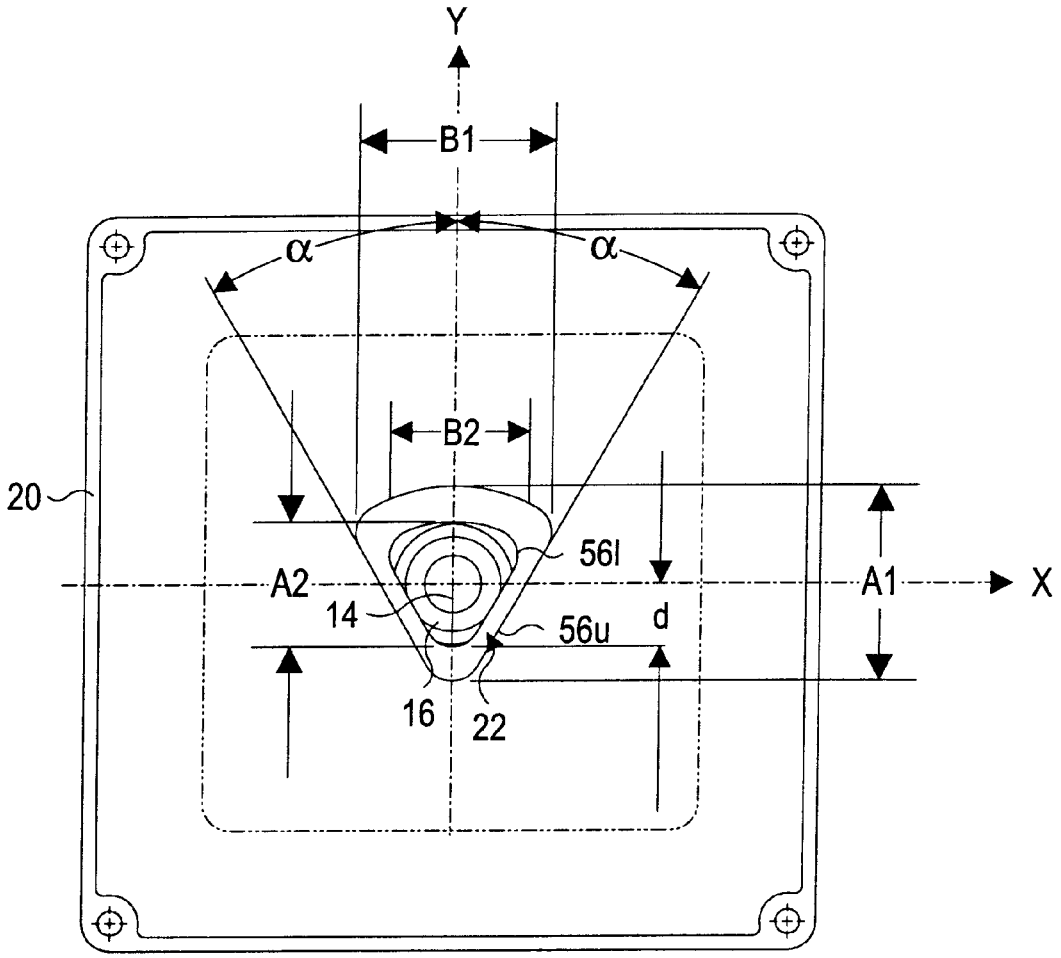
FIG. 2 is a top view of the joystick assembly of FIGS. 1*a* and 1*b* illustrating a channel boundary defining a range of movement of the joystick handle according to one embodiment of the present invention.

FIG. 2 shows a top view of the support platform 20 and channel 22 which defines a range of movement of the joystick handle 14. The joystick handle 14 is shown in the center of the channel 22 (i.e., at the center of the coordinate system defined by x and y axis 50,52). It should be noted that as the handle 14 is manipulated within the channel 22, its position will appear to be reversed or a "mirror" image of the bottom shaft 18 shown (FIG. 1*a*). This is because the handle 14 and bottom shaft 18 represent opposite ends of the joystick 12 which pivots about center ball 16. Thus, for example, when the joystick 12 is in the neutral position, the bottom shaft 18 is at position (0, d) and the handle 14 is at position (0, −d).

In the illustrated embodiment, the channel 22 has a generally tear-drop shaped periphery 56 which tapers inwardly toward the ball center 16 of the joystick 12. A lower-most (and thereby narrowest) portion of the periphery is designated by reference numeral 56*l* and an upper-most (widest) portion of the periphery is designated by reference numeral 56*u*. In one embodiment, symmetrical angles $\alpha$ on either side of the y axis define the left- and right-most boundaries of the channel 22. In one embodiment, the angles $\alpha$ are about 30 degrees. The range of angular motion achievable by the joystick is $2\alpha$, or about 60 degrees. In one embodiment, the degree of taper of the channel 22 corresponds to the angles $\alpha$. Thus, where the angle $\alpha$ is about 30 degrees, the degree of taper between the lower-most and upper-most portions of channel 22 is also about 30 degrees. Thus, when the joystick handle 14 is displaced to the left-most or right-most boundary of the channel 22, it will contact both the upper and lower portions 56*u,l* of the channel 22 at generally the same time.

In FIG. 2, the variable "$A_1$" represents the distance between the outermost vertical boundaries of the channel 22 at its upper surface (i.e., the distance between the points defining the intersection of upper boundary 56*u* and the y axis). Similarly, the variable "$A_2$" represents the distance between the outermost vertical boundaries of the channel 22 at its lower surface (i.e., the distance between the points defining the intersection of lower boundary 56*l* and the y axis). The variable "$B_1$" represents the distance between the outermost horizontal boundaries of the channel 22 at its upper surface and the variable "$B_2$" represents the distance between the outermost horizontal boundaries of the channel 22 at its lower surface. In one embodiment, $A_1$ and $B_1$, are both about 1.73 inches, $A_2$ is about 1.10 inches and $B_2$ is about 1.13 inches. In this embodiment, the distance d defining the displacement of the handle from the origin is about 0.864 inches. It will be appreciated, however, that the channel 22 may define any of several alternative sizes or shapes. The channel 22 might comprise, for example, a triangular, square or circular shape.

Such alternative shapes and sizes of channel(s) 22 may be customized for a particular game or may be provided in modular fashion with universal components. Modular-type channels may be advantageously employed, for example, in retrofit applications, where one desires to remove the channel associated with a first game and replace it with a channel more appropriate for a second game.

Figure 3B:
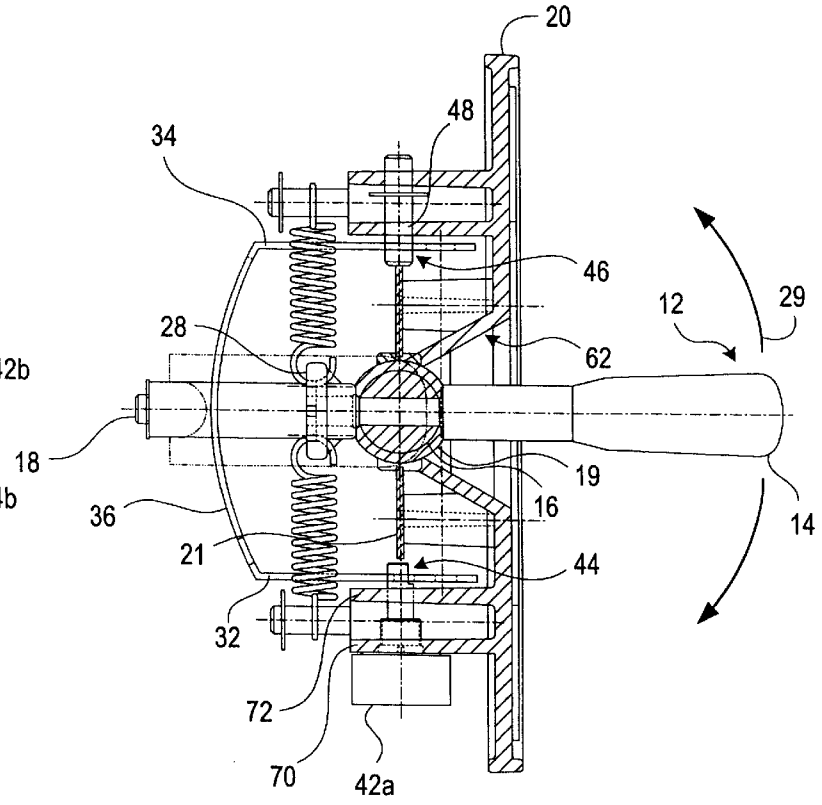
FIG. 3*b* is a side view of the joystick assembly of FIG. 3*a;*
Figure 3A:
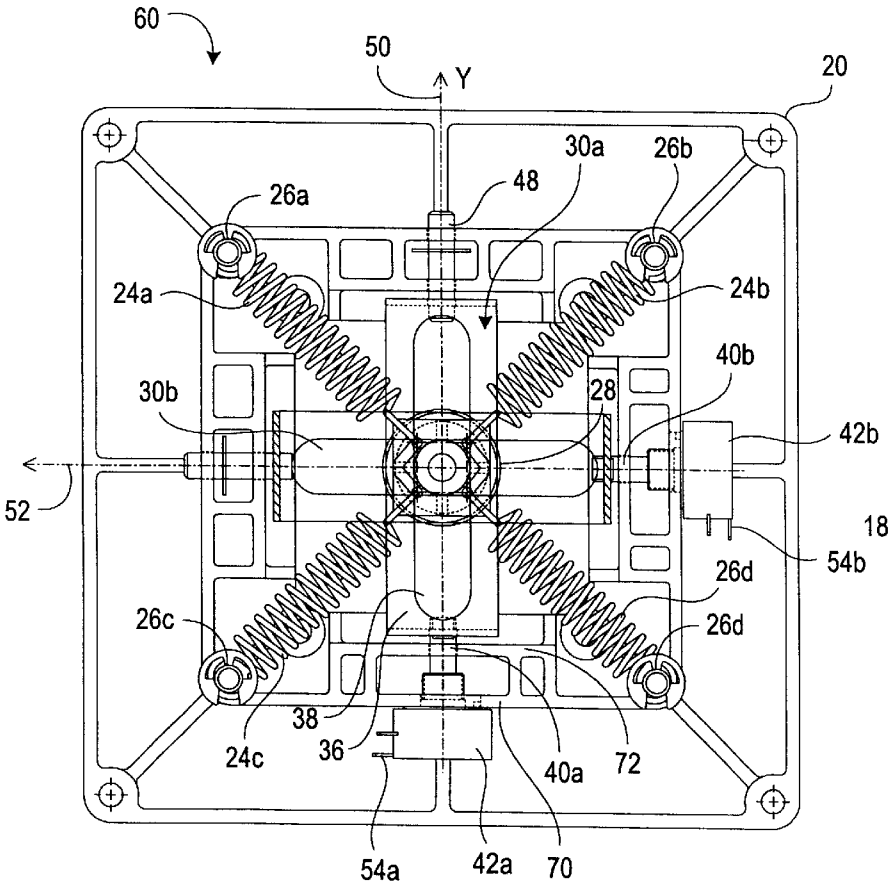
FIG. 3*a* is a bottom view of a joystick assembly having a center-detent characteristic according to one embodiment of the present invention.

Now turning to FIGS. 3*a* and 3*b*, there is shown a joystick assembly 60 having a center-detent characteristic according to one embodiment of the present invention. The joystick assembly 60 includes a joystick 12 having a handle 14, a pivoting center ball 16 and a bottom shaft 18 mounted to a platform 20, each of which generally correspond to the structures of FIGS. 1*a* and 1*b*. The platform 20 has a cut-out portion defining a channel 62 which restricts the range of motion of the handle 14. The channel 62, like the channel 22 in the embodiment of FIGS. 1*a* and 1*b*, may comprise virtually any shape including, but not limited to tear-drop, triangular, square or circular shapes. The joystick 12 in the illustrated embodiment rests normally in a center-detent position, that is with the handle 14 normally biased to the center of the channel 22 by the pulling force of four springs 24*a,b,c,d*.

According to one embodiment, the joystick assembly 60 (having four springs 24*a,b,c,d*) may be assembled from the joystick assembly 10 (FIGS. 1*a* and 1*b*), on the same platform 20, by simply connecting two additional springs 24*c,d* to the joystick assembly shown in FIG. 1*a*. Conversely, the joystick assembly 10 (FIG. 1*a*) may be assembled from the joystick assembly 60, on the same platform 20, by simply removing the springs 24*c,d* from the joystick assembly shown in FIG. 3*a*.

The springs 24*a,b,c,d* are connected at one end to respective support rods 26*a,b,c,d* mounted in the platform 20 and at another end to a support bushing 28 surrounding the bottom shaft 18 of the joystick at a position adjacent the center ball 16. As best observed in FIG. 3*b*, the springs 24*a,b,c,d* are positioned generally parallel to the support platform 20 at a relative depth which is less than one-half the depth (i.e., length) of the bottom shaft. In one embodiment, for example, the bottom shaft 18 extends radially from the center ball 16 by a distance of about 2 inches, whereas the springs 24*a,b,c,d* have a maximum depth of less than one inch from the center ball. The entire joystick assembly in one embodiment has a depth of about 3½ inches, measured from a bottom of the platform 20 to the distal end of the bottom shaft 18. The joystick assembly in one embodiment has a square "footprint" defined by the sides of the support platform 20. In one embodiment, each of the sides is 6.3 inches in length, thus defining a footprint area of 40 square inches. In another embodiment particularly useful in retrofit applications, each of the sides is 4⅜ inches in length, thus defining a footprint area of about 19⅛ square inches.

To operate the joystick 12, one pulls the handle 14 in either direction generally indicated by arrows 29 against the biasing force of the springs 24*a,b,c,d* to a desired position within the confines of the channel 62. The bottom shaft 18 of the joystick moves cooperatively with the handle 14 to a position generally opposite that of the handle 14. Movement of the bottom shaft 18 in turn is communicated by means of rotatable brackets 30*a,b* to respective shafts 40*a,b* of two potentiometers 42*a,b*. Each of the brackets 30 define generally yoke-shaped structures having a pair of opposing legs 32, 34 connected by a bridging span 36, wherein the bridging span 36 includes an elongated slot 38 for receiving the bottom shaft 18 of the joystick. In each bracket 30, one of the legs 32, 34 includes a generally D-shaped hole 44 sized to receive a distal end of the potentiometer shaft 40 having a complementary shape and the other of each pair of legs 32, 34 includes a circular hole 46 sized to receive a distal end of a mounting shaft or axle 48 having a complementary shape.

Each of the brackets 30 is positioned orthogonally (i.e., at a right angle) to the other bracket 30 and each bracket 30 is thereby responsive to one component of motion of the bottom shaft 18 in a two-dimensional plane (e.g., an "x-y" plane). The potentiometers 42*a,b*, in turn, are also coupled to the structure 20 along two orthogonal axes such that the respective potentiometer shafts 40*a,b* rotate to positions corresponding to the positions of the respective brackets 30*a,b*. The potentiometers 42*a,b* are mounted such that their body remains fixed and only their shafts 40*a,b* rotate in response to motion of the bottom shaft 18 and brackets 30. In accordance with one aspect of the present invention, the potentiometers 42*a,b* are mounted to the joystick platform with a mounting clip (not shown), which will be described in detail in relation to FIGS. 5*b*–9*d*.

For convenience, the joystick assembly of FIG. 3*a* is shown in relation to an x-y coordinate system having an origin at the center of the support platform 20. The "y" axis 50 is oriented vertically and the "x" axis 52 oriented horizontally relative to the support platform 20 in FIG. 3*a*. In the illustrated embodiment, bracket 30*a* is positioned in alignment with the "y" axis 50 and is movable left and right relative to the "y" axis in response to "x" components of movement of the bottom shaft 18. Bracket 30*b* is positioned in alignment with the "x" axis 52 and is movable up and down relative to the "x" axis in response to "y" components of movement of the bottom shaft 18. Movement of the respective brackets 30*a,b* causes movement of the respective potentiometer shafts 40*a,b*, thereby communicating electrical signals through leads 54*a,b* to a controller (not shown) which processes the signals to control movement of the game character, symbol or other item under control.

In the embodiment of FIGS. 3*a* and 3*b*, with the bottom shaft 18 in its naturally-biased center position, the springs 24*a,b,c,d* are each oriented at an angle of about 45 degrees relative to the respective brackets 30*a,b* such that upon movement of either bracket 30*a,b*, each spring 24*a,b,c,d* contributes a biasing force to the bottom shaft 18. In one embodiment, the springs 24*a,b,c,d* in their basic form have a free length of about 1¾ inches and, as best observed in FIG. 3*a*, are pre-loaded to about 1.4 times their initial free length, or about 2½ inches. When fully extended, the springs 24*a,b,c,d* are stretched to about 1.7 times their initial free length, or about 3 inches. It will be appreciated, however, that other designs according to the present invention may include alternate orientations and/or stretched configurations of the springs 24*a,b,c,d*. Preferably, however, the springs 24*a,b,c,d* will be oriented at an angle relative to the respective brackets 30*a,b* and will be pre-loaded when the bottom shaft is in its naturally-biased position to produce a non-guided feel (i.e., an absence of preferential motion) when moving the shaft 18 about the x- and y-axes.

Thus, for example, consider the forces contributed by the springs in response to various movements of the bottom shaft 18. In the initial position, each of the springs 24*a,b,c,d* are pre-loaded and the bottom shaft 18 is subject to an equal biasing force from each spring 24*a,b,c,d* thereby producing a net biasing force of zero which maintains the bottom shaft in its center position. As the bottom shaft is moved downward along the "y" axis 50, springs 24*a,b* will exert a greater biasing force than springs 24*c,d* thereby producing a net biasing force which tends to pull the joystick back to its center position. Conversely, as the bottom shaft is moved upward along the "y" axis 50, springs 24*c,d* will exert a greater biasing force than springs 24*a,b* thereby producing a net biasing force which also tends to pull the joystick back to its center position. Similarly, as the bottom shaft 18 is moved along the "x" axis 52, it will experience a net biasing force which tends to pull it back toward the center position. In particular, if the bottom shaft is moved to the right, spring pair 24*a,c* will contribute a greater biasing force than spring pair 24*b,d* and conversely, if the bottom shaft is moved to the left, spring pair 24*b,d* will contribute a greater biasing force than spring pair 24*a,c*, either of which results in a net biasing force which will tend to pull the bottom shaft 18 toward its center position. Of course, variations of any of the above-described movements in which the bottom shaft has both "x" and "y" components of movement will also produce a net biasing force which tends to pull the bottom shaft 18 back toward its center position.

Although the contributions to the net biasing force from the individual springs 24*a,b,c,d* vary according to the position of the joystick, the net biasing force produced by the combination of springs 24*a,b,c,d* does not significantly vary from point to point. Consequently, because of these non-appreciable differences in the net biasing force contributed by the springs 24*a,b* as the joystick 12 is moved, there is no particular axis which may be considered to comprise a "preferential" axis of movement of the joystick 12.

Joystick apparatus 60 thereby defines a structure which provides non-preferential movement of the joystick 12 by the action of springs 24*a,b,c,d* which are mounted parallel to the support structure 20. Because the springs 24*a,b,c,d* are mounted at a relative depth which is only about one-half the depth reached by the bottom shaft 18, the entire joystick assembly 60 is relatively compact so that it may be mounted within a relatively small space. While this feature is advantageous for any game, it is particularly advantageous in retrofit applications where the available space for the joystick apparatus can be limited by the prior game cabinet design.

Figure 4:
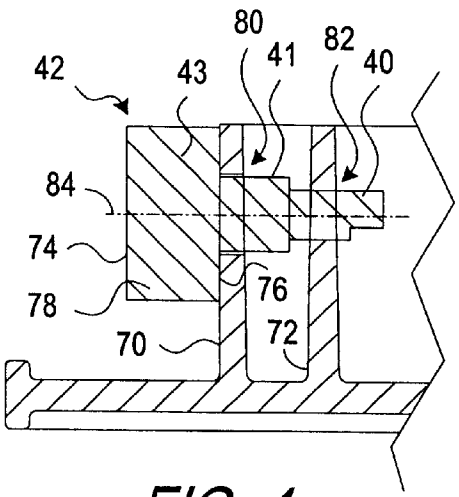
FIG. 4 is a side view of a potentiometer positioned relative to a support wall.

Now turning to FIG. 4, there is shown a magnified side sectional view of a rotary potentiometer 42 positioned relative to support walls 70,72, which comprise in one embodiment portions of a joystick assembly. The potentiometer 42 comprises a rotary potentiometer having a rotatable shaft 40, a body portion 43 and an intermediate shaft section 41. The potentiometer 42 may comprise either of the potentiometers 42*a,b* shown in FIGS. 1*a* and 1*b* or 3*a* and 3*b* and the support walls 70,72 corresponding portions of the joystick support structure 20 of FIGS. 1*a*, 1*b*, 3*a*, 3*b*. It will be appreciated, however, that the support walls 70,72 (or a single wall 70) may comprise portions of any structure which uses rotary potentiometers, including structures other than joystick assemblies.

The body portion 43 is generally disk-shaped, defining an outer flat surface 74, an inner flat surface 76 and a cylindrical surface 78 bridging the inner and outer flat surfaces 74,76. The support walls 70,72 have respective openings 80, 82 aligned relative to a horizontal axis 84. Opening 80 is sized to receive the intermediate shaft section 41, and opening 82 is sized to receive the shaft 40 of the potentiometer 42. In one embodiment, the potentiometer 42 has an overall length of about 1¼ inches, the body portion 43 contributing about ½ inch, the intermediate shaft section 41 contributing about ¼ inch and the shaft 40 contributing about ½ inch to the overally length, whereas the height of walls 70,72 is about 1¼ inch and the distance between walls 70,72 is about ⅜ inch. It will be appreciated, however, that other sizes and configurations of potentiometers and support walls may be used.

The potentiometer 42 is positioned in alignment with horizontal axis 84 and relative to support walls 70,72 such that the inner flat surface 74 is adjacent to support wall 70, the intermediate shaft section 41 projects through opening 80 and the shaft 40 projects through opening 82. Alternatively, the support structure 20 may be provided without a second support wall 72, in which case the potentiometer 42 is positioned in alignment with horizontal axis 84 and relative to support walls 70 such that the inner flat surface 74 is adjacent to support wall 70, the intermediate shaft section 41 projects through opening 80 and the free end of shaft 40 is unsupported by a second support wall. In either case, the free end of shaft 40 is adapted to engage with a bracket 30 of the type shown in FIGS. 1*a* and 1*b* or 3*a* and 3*b* or other suitable means so that a desired component of motion of the joystick is communicated to rotational motion of the potentiometer shaft 40.

Figure 5A:
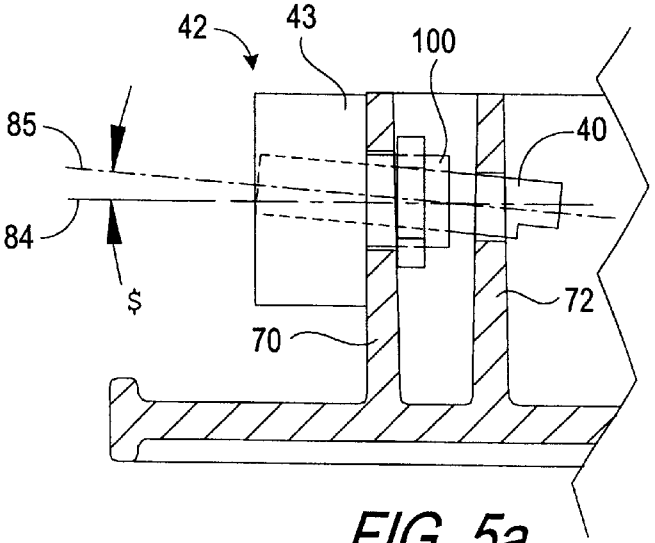
FIG. 5*a* is a side view of the potentiometer and support wall of FIG. 4 with the potentiometer mounted in the manner of the prior art.

Heretofore, securing a potentiometer 42 to a support wall 70 (whether the support wall comprises a portion of a joystick assembly or another structure) has been accomplished with a mounting nut 100, as shown in FIG. 5*a*. The mounting nut 100 is threadedly engaged with the intermediate shaft section 41 of the potentiometer and tightened such that the potentiometer body 43 is held firmly against the support wall 70. This method can adversely affect the failure rate of the potentiometer 42 because it can "pre-load" the potentiometer shaft 40 with a side-loading force which contributes to misalignment of the potentiometer shaft 40 with the desired axis of rotation. Such misalignment can hinder or entirely stop (i.e., "seize") rotation of the potentiometer shaft and/or cause it to rotate in an eccentric fashion. This, in turn, can cause premature failure of the potentiometer and/or joystick and can also compromise the accuracy of the control signals obtained from the potentiometer 42. Side-loading, generally, which can result from aggressive use of the joystick, also can contribute to failure and/or inaccuracy of the potentiometer. Sidewall 72, where provided, can serve to dissipate some of the side-loading forces but, when the potentiometer is fixedly secured with a mounting nut, may also contribute to undesired pre-loading of the potentiometer shaft, especially where the holes 80,82 in the respective sidewalls 70,72 are not perfectly aligned.

As illustrated in FIG. 5*a*, a likely effect of such pre-loading and/or side-loading forces is that the potentiometer shaft 40 becomes misaligned relative to the horizontal axis 84 (e.g., on axis 85, at angle β relative to axis 84). The angle β will of course vary depending on the amount of such pre-loading and/or side-loading forces, but generally will range from 0 to 3 degrees. Because the mounting nut 100 holds the potentiometer body 43 firmly against the support wall 70, the potentiometer body 43 remains oriented with the horizontal axis 84, out of alignment with the potentiometer shaft 40. Accordingly, rotation of the potentiometer shaft 40 (e.g., in response to movements of the joystick shaft) is skewed or eccentric in relation to the potentiometer body 43. This, as described above, can contribute to inaccurate results, seizing up of the potentiometer shaft and premature failure of the potentiometer 42.

Moreover, it is often the case that the structure to which the potentiometer is to be mounted includes only a small space for manipulating the mounting nut, and accordingly the prior art process can be cumbersome and time consuming. For example, with reference to FIG. 4, it is observed that there is only a small, cramped space between sidewalls 70,72, only ⅜ inch deep and 1¼ inch wide in one embodiment. Certainly, such a confined space is only slightly larger than the mounting nut itself and does not accommodate a quick and/or easy installation of the potentiometer.

Figure 5B:
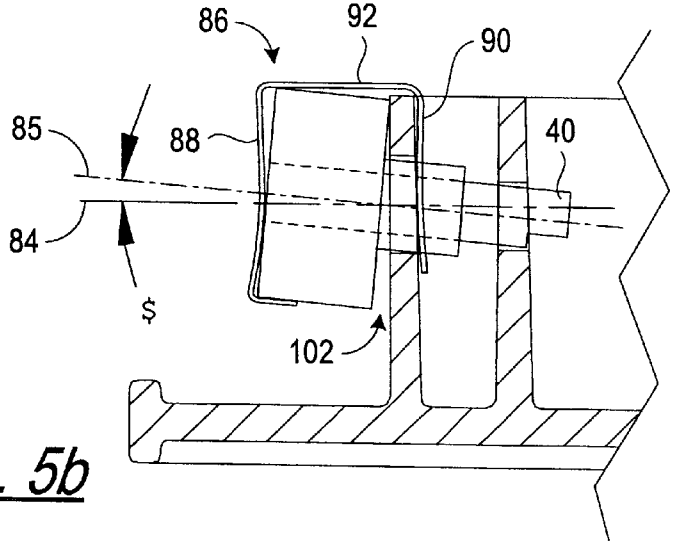
FIG. 5*b* is a side view of the potentiometer and support wall of FIG. 4 with a potentiometer mounting clip according to one embodiment of the present invention.

FIG. 5*b* illustrates the mounting of the potentiometer 42 to the support wall 70 with a mounting clip 86 according to one embodiment of the present invention. The mounting clip 86 "non-fixedly" secures the potentiometer body 43 in position against the support wall 70 such that it is permitted a degree of "play" or movement, sometimes referred to as "compliance," in response to pre-loading or side-loading forces. More particularly, in response to such pre-loading or side-loading forces, the potentiometer shaft 40 moves out of alignment with the horizontal axis 84 (e.g., at angle β relative to axis 84) in generally the same manner described in relation to FIG. 5*a*. With the mounting clip, however, the potentiometer body 43 is not held firmly against the support wall 70 but rather is permitted up to about 10 degrees of separation 102 from the support wall 70. The effect of this freedom of movement is that the potentiometer body 43 is always aligned with the potentiometer shaft 40, whether it be along axis 84 or 85. Accordingly, rotation of the potentiometer shaft 40 (e.g., in response to movements of the joystick shaft) is not skewed or eccentric in relation to the potentiometer body 43.

Moreover, the mounting clip can be mounted much more quickly and easily than a mounting nut because it does not require manipulation of any structure between the small, cramped space between sidewalls 70,72. The mounting clip 86 and a process for using the mounting nut 86 will hereinafter be described in greater detail in relation to FIGS. 6*a* through 9*d*.

Figure 6B:
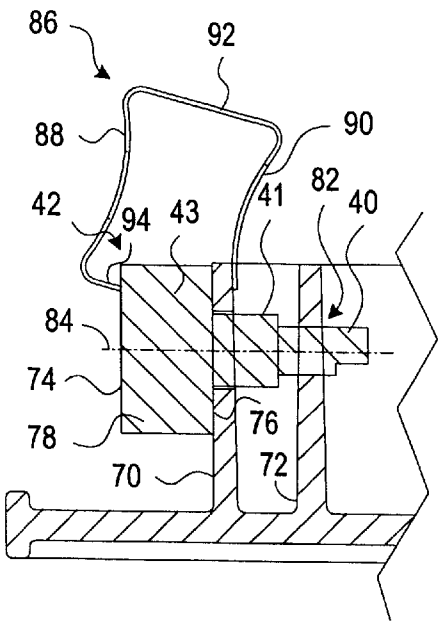
FIG. 6*b* is a side view of the potentiometer and support wall of FIG. 4 with the mounting clip of FIG. 5*b* during installation.
Figure 6C:
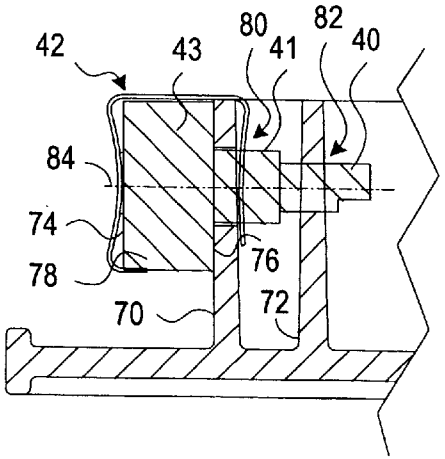
FIG. 6*c* is a side view of the potentiometer and support wall of FIG. 4 with the mounting clip of FIG. 5*b* after installation.
Figure 6A:
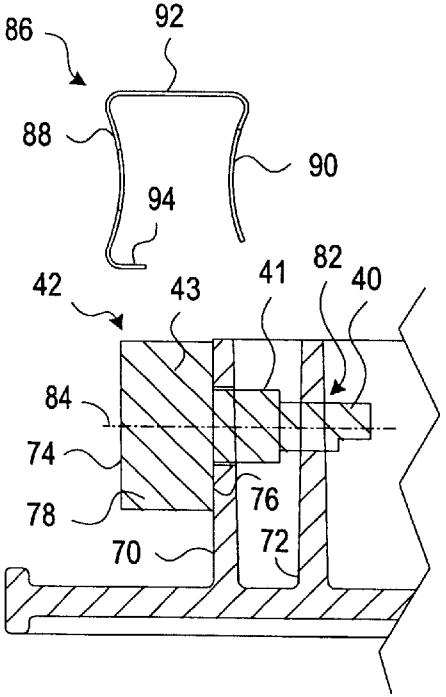
FIG. 6*a* is a side view of the potentiometer and support wall of FIG. 4 with the mounting clip of FIG. 5*b* before installation.
Figure 7B:
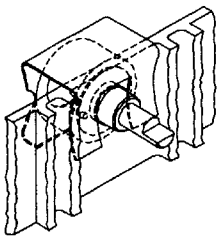
FIG. 7*b* is a perspective view of the potentiometer and support wall of FIG. 4 with the mounting clip of FIG. 5*b* after installation.
Figure 7A:
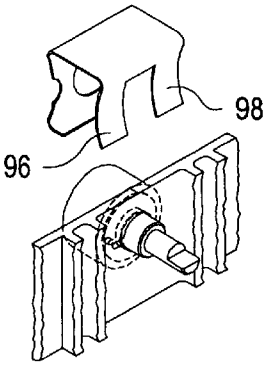
FIG. 7*a* is perspective view of the potentiometer and support wall of FIG. 4 with the mounting clip of FIG. 5*b* before installation.
Figure 8:
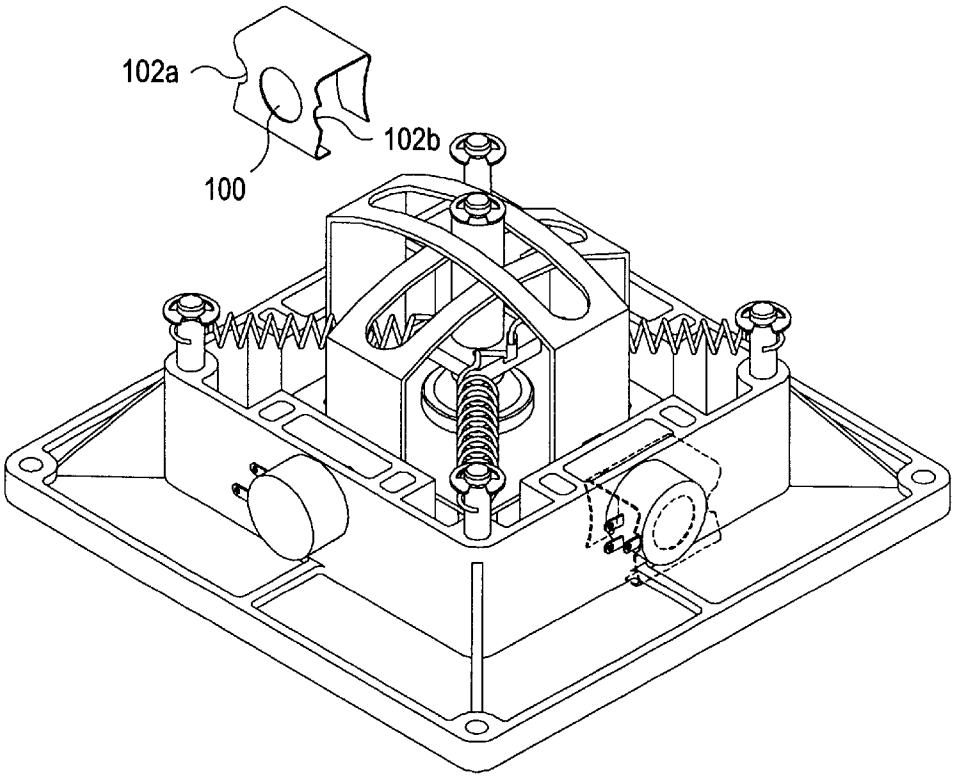
FIG. 8 is a perspective view of the joystick assembly of FIGS. 3*a* and 3*b* with mounting clips according to the present invention shown both before and after installation.
Figure 9B:
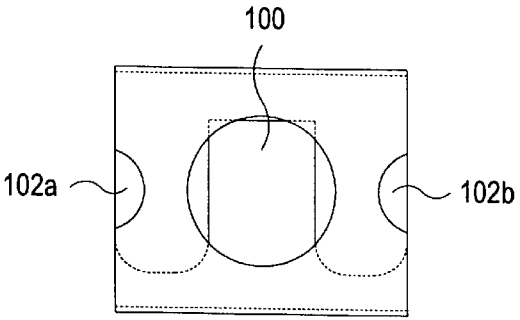
FIG. 9*b* is a front view of the potentiometer mounting clip of FIG. 9*a;*
Figure 9A:
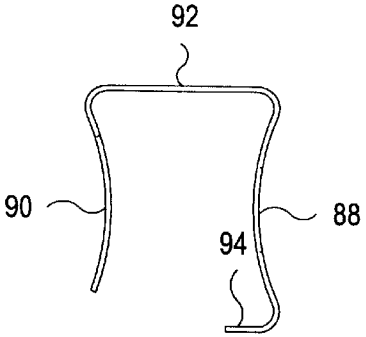
FIG. 9*a* is a side view of a potentiometer mounting clip of the type shown in FIGS. 5*b* through 8.
Figure 9D:
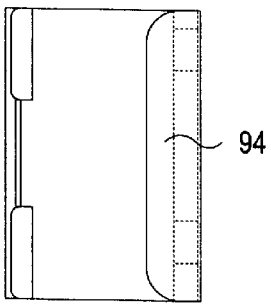
FIG. 9*d* is a bottom view of the potentiometer mounting clip of FIG. 9*a*.
Figure 9C:
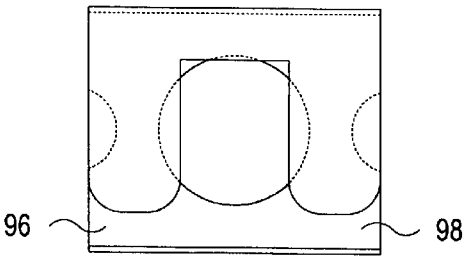
FIG. 9*c* is a back view of the potentiometer mounting clip of FIG. 9*a*.

FIGS. 6*a* through 6*c* and 7*a* and 7*b* illustrate various steps in using the mounting clip 86 of FIG. 5*b* to mount a potentiometer to the support wall of FIG. 4. More particularly, FIGS. 6*a* and 7*a* show the assembly of FIG. 4 before installation, FIG. 6*b* during installation and FIG. 6*c* and 7*b* after installation of the mounting clip 86. Other view of the mounting clip 86 are shown in FIG. 8 (perspective view relative to joystick assembly, both before and after installation), FIG. 9*a* (side view), FIG. 9*b* (front view), FIG. 9*c* (back view) and FIG. 9*d* (bottom view).

The mounting clip 86 comprises a front side segment 88 and back side segment 90 bridged by a top segment 92, thereby defining a generally U-shaped cross section. In one embodiment, the front side segment 88 turns inwardly at its lower edge to define a bottom flange 94, the back side segment 90 includes a pair of legs 96,98 (FIG. 7*a*); and the front side segment 88 has a circular clearance hole 100 and two-semi-circular notches 102*a*,*b* (FIG. 8).

The mounting clip 86 in one embodiment is of unitary construction and is comprised of sheet metal having a thickness of about 20 mils. More particularly, in one embodiment the mounting clip comprises soft-annealed spring steel, S.A.E. specification of 1074 to 1095 (A.S.T.M. specification A 684), hardened to a Rockwell C scale of 40 to 60 units. In a preferred embodiment, the front and back side segments 88,90 are curved inwardly and are elastically deformable relative to each other between a naturally biased position and an outward flexed position.

It will be appreciated that the mounting clip 86 may be constructed from any of several alternative materials or combinations of materials including, but not limited to, extruded nylon or any thermoplastic or thermoset plastic material. Where the mounting clip is constructed of alternative materials, it is generally preferred that it have a thickness greater than 20 mils. For example, in one embodiment, the mounting clip is constructed of plastic and has a thickness of 30 to 40 mils.

In a preferred embodiment, the mounting clip 86 has a height of 0.92 inches, width of 1.09 inches and a depth (between front and back segments 88,90) of 0.58 inches. The clearance hole 100 has a diameter of 0.56 inches (before forming), the bottom flange 94 has a depth of about 0.12 inches and the front and back segments 88,90 are curved with a respective radii of curvature of 4.4 and 4.7 degrees. It will be appreciated, of course, that the mounting clip 86 may be constructed with alternative dimensions if desired. The mounting clip might also be constructed with front and back side segments 88,90 which are curved outwardly, rather than inwardly. In either case, the mounting clip "non-fixedly" secures the potentiometer to the support wall such that the potentiometer is free to move somewhat in response to side-loading forces.

Mounting of the potentiometer 42 relative to the support wall 70 is accomplished in one embodiment by first placing the mounting clip 86 in the position shown in FIG. 6*a*, generally above the potentiometer 42, where the inner flat surface 76 of the potentiometer 42 is adjacent to the support wall 70 and the potentiometer shaft 40 penetrates through the opening 80 in the support wall. Where the support structure 20 includes a second support wall 72, the free end of shaft 40 penetrates through the second support wall 72. Then, the mounting clip 86 may be moved downward to the position shown in FIG. 6*b*, wherein a lower portion of the back side segment 90 is engaged with an upper portion of the support wall 70 and a lower portion of the front side segment 88 is engaged with the outer flat surface 74 of the potentiometer 42. From the position of FIG. 6*b*, the front side segment 88 is flexed outwardly and then the mounting clip 86 is moved downward in a sliding contact with the potentiometer 42 until the bottom flange 94 snaps underneath the body portion 78. The front side segment 88 in one embodiment then springs back toward its naturally biased position, with the body portion 78 of the potentiometer being received and retained between the front and back side segments 88,90 and the legs 96,98 straddling the potentiometer shaft 40, as shown in FIGS. 5*b* and 6*c*.

With the potentiometer so mounted, the potentiometer body 43 is not held firmly against the support wall 70 but rather is permitted a degree of separation 102 from the support wall 70, as described in relation to FIG. 5*b*. Accordingly, the potentiometer body 43 is free to move in response to side-loading forces and remains aligned with the potentiometer shaft 40, thus prolonging the useful life of the potentiometer and maintaining its accuracy.

While the present invention has been described with reference to one or more particular embodiments, those skilled in the art will recognize that many changes may be made thereto without departing from the spirit and scope of the present invention. Each of these embodiments and obvious variations thereof is contemplated as falling within the spirit and scope of the claimed invention, which is set forth in the following claims.

What is claimed is:

1. A method of mounting a rotary potentiometer relative to a support wall of a joystick assembly, the potentiometer defining a generally disk-shaped body portion and a shaft, the body portion comprising an outer flat surface and an inner flat surface bridged by a cylindrical surface, the potentiometer shaft projecting outwardly from the inner flat surface along a longitudinal axis, the support wall having an opening therein for accommodating the potentiometer shaft, the method comprising the steps of:

placing the potentiometer in a position wherein the inner flat surface is adjacent to the support wall and the potentiometer shaft penetrates through the opening in the support wall;

obtaining a mounting clip comprising front and back opposing side segments and a top segment bridging said front and back side segments, the back side segment defining a pair of legs, a bottom portion of the front side segment turning inwardly toward the back side segment to define a bottom flange, and the front and back side segments being elastically deformable relative to each other between a naturally biased position and an outward flexed position, orienting the mounting clip above the potentiometer in a position wherein a lower portion of the front side segment is engaged with the outer flat surface of the potentiometer and a lower portion of the back side segment is engaged with the support wall;

flexing the front side segment outwardly toward its outward flexed position;

sliding the mounting clip downward to a position wherein the bottom flange snaps underneath the body portion of the potentiometer, the front side segment thereby springing back toward its naturally biased position, the body portion of the potentiometer thereby being received and retained between said front and back side segments and the legs straddling the potentiometer shaft.

2. The method of claim 1 wherein said step of placing the potentiometer in a position further includes non-fixedly projecting the potentiometer shaft through the opening in the support wall.

3. The method of claim 2 further including the step of securing the potentiometer to the support wall with the mounting clip in a manner that permits deflection of the potentiometer shaft in response to side loading forces.

4. The method of claim 1 further including the step of securing the potentiometer to the support wall by a compressive force component parallel to the shaft provided by the front and back side segments being deformed to the outward flexed position in a position overlaying and compressing therebetween the body portion and a portion of the support wall.

5. The method of claim 1 further including the steps of:

providing a clearance hole defined in the front side segment; and positioning the clearance hole such that it overlays a center portion of the potentiometer.

6. The method of claim 1 further including the step of providing at least one wire clearance notch defined in the front side segment.

7. The method of claim 6 wherein the potentiometer includes at least one electrical terminal for receiving wires, the method further including the step of positioning the potentiometer such that the wire clearance notch overlays the electrical terminal.

8. A method of mounting a potentiometer relative to a support wall, the potentiometer defining a body portion and a shaft, the support wall having an opening therein for accommodating the shaft, the method comprising the steps of:

providing a mounting clip having front and back opposing side segments and a top segment bridging the front and back side segments;

positioning the potentiometer such that the shaft projects through the opening in the support wall; and securing the potentiometer to the support wall with the mounting clip such that the body portion and a portion of said support wall is received between the front and back side segments and retained by a compressive force component applied by the mounting clip parallel to the shaft.

9. The method of claim 8 wherein said step of providing a mounting clip includes providing a bottom portion of the front side segment that turns inwardly toward the back side segment to define a bottom flange, the bottom flange underlying a portion of the potentiometer and retaining the mounting clip in position about the potentiometer.

10. The method of claim 8 wherein said step of providing a mounting clip further includes providing the back side segment with a pair legs, and wherein said step of positioning the potentiometer further includes positioning the potentiometer such that the legs straddle the shaft.

11. The method of claim 8 wherein said step of positioning the potentiometer further includes non-fixedly positioning the shaft through the opening.

12. The method of claim 11 wherein said step of securing the potentiometer further includes securing the potentiometer in a manner that permits deflection of the potentiometer shaft in response to side loading forces.

13. The method of claim 8 wherein said step of providing a mounting clip further includes providing a mounting clip having a clearance hole defined in the front side segment, the method further including the step of positioning the clearance hole such that it overlays a center portion of the potentiometer.

14. The method of claim 8 wherein said step of providing a mounting clip further includes providing at least one wire clearance notch defined in the front side segment.

15. The method of claim 14 wherein the potentiometer includes at least one electrical terminal for receiving wires, the method further including the step of positioning the potentiometer such that the wire clearance notch overlays the electrical terminal.

* * * * *